US011096422B2

(12) United States Patent
Hu et al.

(10) Patent No.: US 11,096,422 B2
(45) Date of Patent: Aug. 24, 2021

(54) ATOMIZER AND ELECTRONIC CIGARETTE HAVING SAME

(71) Applicant: Shenzhen First Union Technology Co., Ltd., Shenzhen (CN)

(72) Inventors: Jie Hu, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 273 days.

(21) Appl. No.: 16/269,574

(22) Filed: Feb. 7, 2019

(65) Prior Publication Data

US 2019/0246694 A1 Aug. 15, 2019

(30) Foreign Application Priority Data

Feb. 9, 2018 (CN) ..... 201820241885.8

(51) Int. Cl.

| | |
|---|---|
| ***F22B 1/28*** | (2006.01) |
| ***A24F 40/46*** | (2020.01) |
| ***A24F 40/485*** | (2020.01) |
| *A24F 40/10* | (2020.01) |

(52) U.S. Cl.

CPC ..... *A24F 40/46* (2020.01); *A24F 40/485* (2020.01); *A24F 40/10* (2020.01)

(58) Field of Classification Search

CPC ..... C23C 16/4481; F22B 1/282
USPC ..... 165/164; 392/450
See application file for complete search history.

(56) References Cited

U.S. PATENT DOCUMENTS

| | | | | |
|---|---|---|---|---|
| 3,270,182 A * | 8/1966 | Hynes | F24H 3/0405 392/492 |
| 3,782,456 A * | 1/1974 | Gusmer | F28D 7/0041 165/164 |
| 3,882,934 A * | 5/1975 | Knoos | F28D 9/04 165/164 |
| 9,982,341 B2 * | 5/2018 | Schoepp | C23C 16/4481 |

(Continued)

FOREIGN PATENT DOCUMENTS

| | | |
|---|---|---|
| CN | 107 080 289 A | 8/2017 |
| GB | 2 542 012 A | 3/2017 |

*Primary Examiner* — Phuong Chi Thi Nguyen
(74) *Attorney, Agent, or Firm* — Proi Intellectual Property US

(57) ABSTRACT

A heating device includes: a liquid storage chamber configured for storing tobacco liquid; the liquid storage chamber comprising a liquid conducting hole; a heating component comprising at least one heating element and a receiving cavity; the at least one heating element being received in the receiving cavity; and between the heating element and the receiving cavity or between the adjacent heating elements including a liquid storage sump; the heating component being connected with the liquid storage chamber; and the heating element being disposed under the liquid conducting chamber and corresponding with the liquid conductive hole; the tobacco liquid in the liquid storage chamber flowing towards the heating element, through the liquid conductive hole, the heating element heating the tobacco liquid for atomization; the liquid storage sump configured for storing some of tobacco liquid leaking from the heating element, the heating element atomizes the tobacco liquid in the liquid storage sump.

19 Claims, 6 Drawing Sheets

(56) References Cited

U.S. PATENT DOCUMENTS

| | | | | |
|---|---|---|---|---|
| 2018/0035720 | A1 | 2/2018 | Qiu | |
| 2020/0288779 | A1* | 9/2020 | Chen | A24F 7/00 |

* cited by examiner

ATOMIZER AND ELECTRONIC CIGARETTE HAVING SAME

TECHNICAL FIELD

The present disclosure relates to the field of electronic cigarettes, and particularly to an atomizer and an electronic cigarette having same.

BACKGROUND ART

The electronic cigarettes containing tobacco liquid generates an aerosol mainly by an atomizer heating the tobacco liquid. Compared with traditional cigarettes, they have advantages of good portability, no open flame and environmental friendly, becoming one of mature alternatives to smoking, therefore enjoying a popularity boom by smokers.

During invention process, a problem known to the inventors: the electronic cigarettes containing tobacco liquid have problems of different levels of tobacco leakage. When the tobacco liquid leak to outside of the atomizer, it would influence a heating effect. A method known to inventors, the problem of tobacco leakage is mainly realized by changing structures of air passages or adjusting tobacco storage medium, however, by this way, it only improves a problem of tobacco leaking to outside, failing to avoid leakage of the tobacco liquid to inside of the atomizer.

SUMMARY

In view of the drawbacks in the prior art, the present disclosure relates to an atomizer and an electronic cigarette having the same, which are capable of preventing tobacco liquid therein from leaking into the atomizer.

In order to solve the above technical problem, the present disclosure provides a heating device, such as an atomizer, according to independent claim 1 whereas various embodiments of the atomizer and improvements thereto are recited in the dependent claims. The atomizer includes: a liquid storage chamber configured for storing tobacco liquid; the liquid storage chamber includes a liquid conducting hole;

a heating component including at least one heating element and a case; the at least one heating element being received in the case; and between the heating element and the case or between the adjacent heating elements including a liquid storage sump; the heating component being connected with the liquid storage chamber; and the heating element being disposed under the liquid storage chamber and corresponding with the liquid conductive hole; the tobacco liquid in the liquid storage chamber flowing towards the heating element, through the liquid conductive hole, the heating element heating the tobacco liquid for atomization;

the liquid storage sump being configured for storing some of tobacco liquid leaking from the heating element, further the heating element atomizes the tobacco liquid in the liquid storage sump.

As used herein, a heating box being made by heat conductive materials, the heating box including a heating compartment formed therein, an upper opening of the heating box being corresponding with the liquid conductive hole;

a heating area, formed on the heating box; and an absorption element, filled in the heating compartment; the absorption element contacting the liquid conductive hole;

Optionally, the heating box is made by ceramic materials; the heating area is a resistive circuit printed on an outside or inside surface of the heating box.

Optionally, a first through hole is bored on a lateral of the heating element; the first through extends through the heating element and is configured for guiding an aerosol generated by atomizing the tobacco liquid to outside of the heating element.

The case has a second through hole bored thereon, the second through hole is configured for guiding exterior air into the case;

The heating element is received in the case, the first through hole and the second through hole are communicated with each other to form an air passage;

Optionally, a total number of the first through holes is at least one;

A total number of the second through holes is at least one; and a position of each second through hole bored is higher than a bottom of the liquid storage sump;

Optionally, the atomizer further includes: an air pipe, passing through the liquid storage chamber, and one end of the air pipe is communicated with inside the case;

Optionally, the liquid storage chamber further includes: a shell; a top cover, connected with one end of the shell, a first through hole is bored on the top cover; a fixing base, connected with another end of the shell; the fixing base has a second through hole communicated with the case; one end of the air pipe is fixed inside the second through hole; an opposite end of the air pipe is fixed inside the first through hole.

Optionally, the liquid conducting hole is bored on the base;

Optionally, the fixing base further has a groove formed thereon; the groove is communicated with the liquid conducting hole and the second through hole, configured for installing the heating component.

Optionally, the atomizer further includes:

a base, the base is connected with the liquid storage chamber to form a case; the heating component is disposed in the case.

To solve the above problem, the present disclosure further provides an electronic cigarette having the atomizer as described supra and a power supply module; the power supply module is coupled with the atomizer and configured for supplying power to the atomizer.

Additional aspects and advantages of the present disclosure will be: the present disclosure relates to an atomizer and an electronic cigarette having same; the atomizer includes a liquid storage chamber and a heating component. The heating component includes a heating element and a case, the heating element is received in the case and a liquid storage sump is formed there-between. As used herein, the heating component is connected with the liquid storage chamber and the heating element is disposed above the liquid conductive hole so that the tobacco liquid stored in the liquid storage chamber will flow by gravity, towards the heating element for atomization. Furthermore, even through leakage of the tobacco liquid exists, the leaking tobacco liquid would flow towards the heating component, stored in the liquid storage sump of the heating component, thus the leaking tobacco is only capable of being stored in the heating component and can't leak to the inside air pipe of the atomizer, which effectively avoids the tobacco liquid to be drawn by the user, enhancing the user experience.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

With reference to FIG. 1 to FIG. 6, 1 represents the electronic cigarette, 10 represents the atomizer, 11 represents the liquid storage chamber, 111 represents the top cover, 1111 represents the first through hole, 112 represents the shell, 113 represents the fixing base, 1131 represents the basal portion, 11311 is the liquid conductive hole, 11312 is the second air hole, 11313 is the groove, 1132 is the extending portion, 114 is the sealing glue, 12 is the heating component, 121 is the case, 1211 is the second through hole, 1212 is the slot, 122 is the heating element, 1221 is the heating box, 12211 is the heating compartment, 1222 is an absorption element; 1223 is the heating area; 1224 is the first through hole; 123 is the liquid storage sump; 13 is the air pipe, 14 is the base, 141 is the threaded connector, 15 is the case, 20 is the power supply.

DETAILED DESCRIPTION

The structure and operating principle of the above heating element with temperature control and the low-temperature baked smoking set having same are illustrated below, mainly shown from FIG. 1 to FIG. 12 in further detail using exemplary embodiments.

Figure 1:
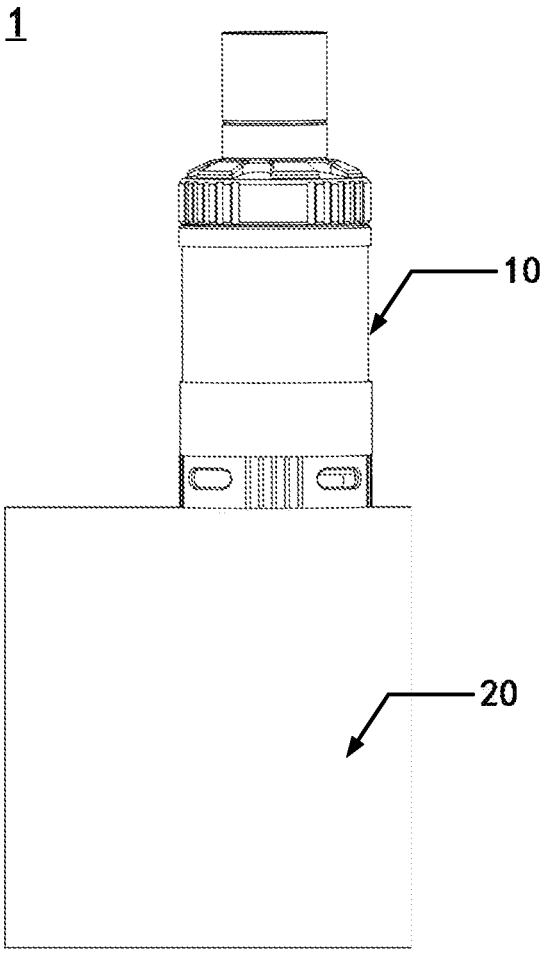
FIG. 1 is an aspect view of an electronic cigarette in accordance with one embodiment of the present disclosure.
Figure 2:
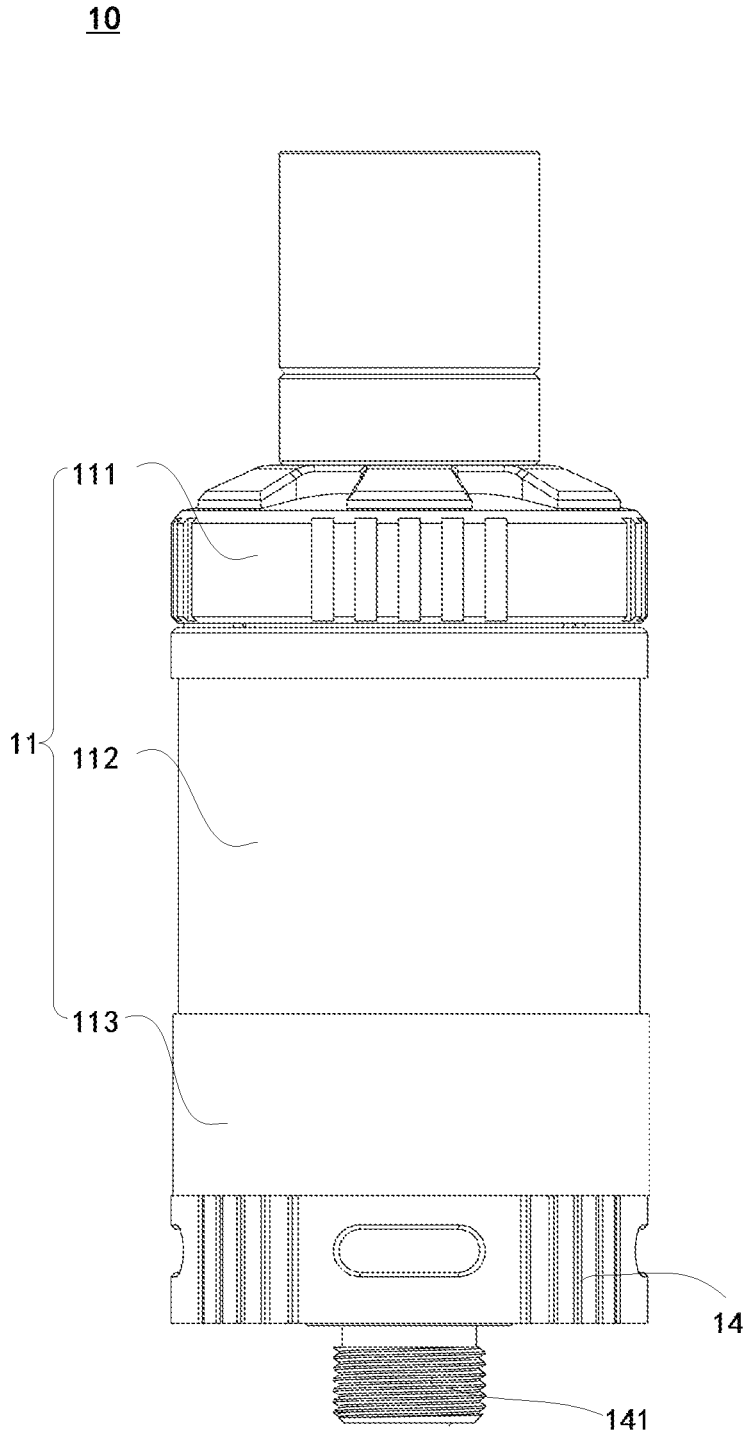
FIG. 2 is an aspect view of the electronic cigarette in accordance with one embodiment of the present disclosure.
Figure 3:
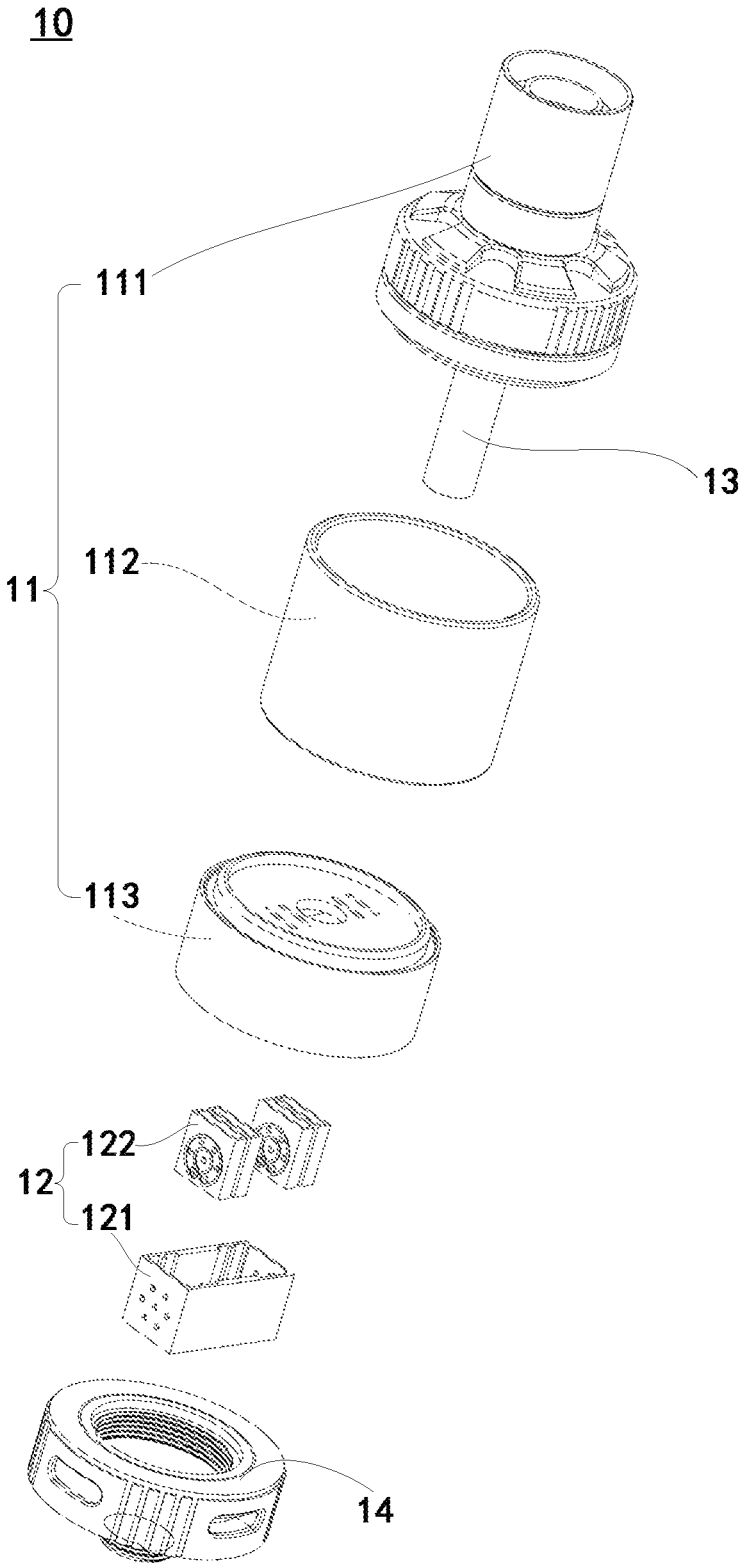
FIG. 3 is an exploded view of the atomizer in FIG. 2.
Figure 4:
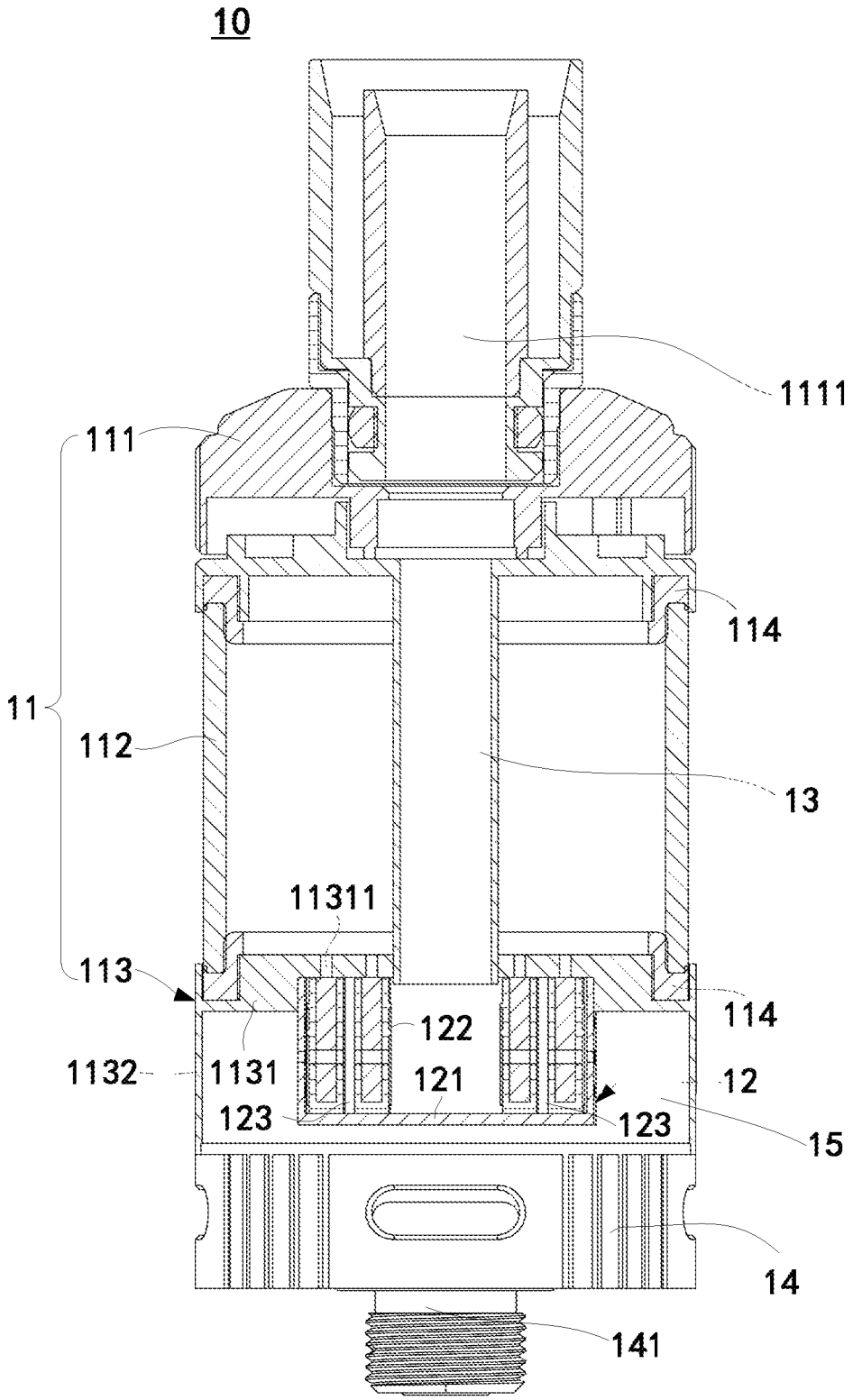
FIG. 4 is a cross-sectional view of the atomizer along C-C in FIG. 2.

Referring to FIG. 1, which is an aspect view of an electronic cigarette in accordance with one embodiment of the present disclosure. The electronic cigarette includes: an atomizer 10 and a power supply 20, the power supply 20 is couple with the atomizer 10 to supply power to the atomizer 10, allowing the atomizer 10 to heat the tobacco liquid for atomization, to generate an aerosol.

More specifically, the power supply 20 is detachably connected with the atomizer 10 via a threaded connector 141. Of course, in some alternative embodiments, the power supply 20 and the atomizer 10 may be coupled via other methods, such as snap fit and rivet joint etc.

Furthermore, with reference to FIG. 2 to FIG. 6, which illustrate the structures of the atomizer in accordance with the embodiments of the present disclosure, the atomizer 10 includes: a liquid storage chamber 11, a heating component 12, an air pipe 13 and a base 14.

The liquid storage chamber 11 is connected with the base 14 and the liquid storage chamber 11 is located above the base 14. Between the liquid storage chamber 11 and the base 14 has a case 15 formed there-between. The heating component 12 is connected with the liquid storage chamber 11 and the heating component 12 is disposed in the case 15; that means the heating component 12 is disposed between the liquid storage chamber 11 and the base 14. The air pipe 13 is passing through the liquid storage chamber 11 and one end of the air pipe 13 is communicated with the heating component 12, enabling an aerosol generated by that the heating component 12 heats the tobacco liquid, to pass through the air pipe 13 so as to supply to the user.

As used herein, the liquid storage chamber 11 includes a shell 112, a top cover 11 and a fixing base 113; the top cover 11, the shell 112 and the fixing base 113 are successively connected from top to bottom.

More specifically, the top cover 111 has a first through hole 1111, the first through hole 1111 is a round-shaped through hole, passing through the top cover 111, located at a middle of the top cover 111, that is, the central axial of the first through hole 1111 is coaxial with the central axial of the top cover 111.

Figure 5:
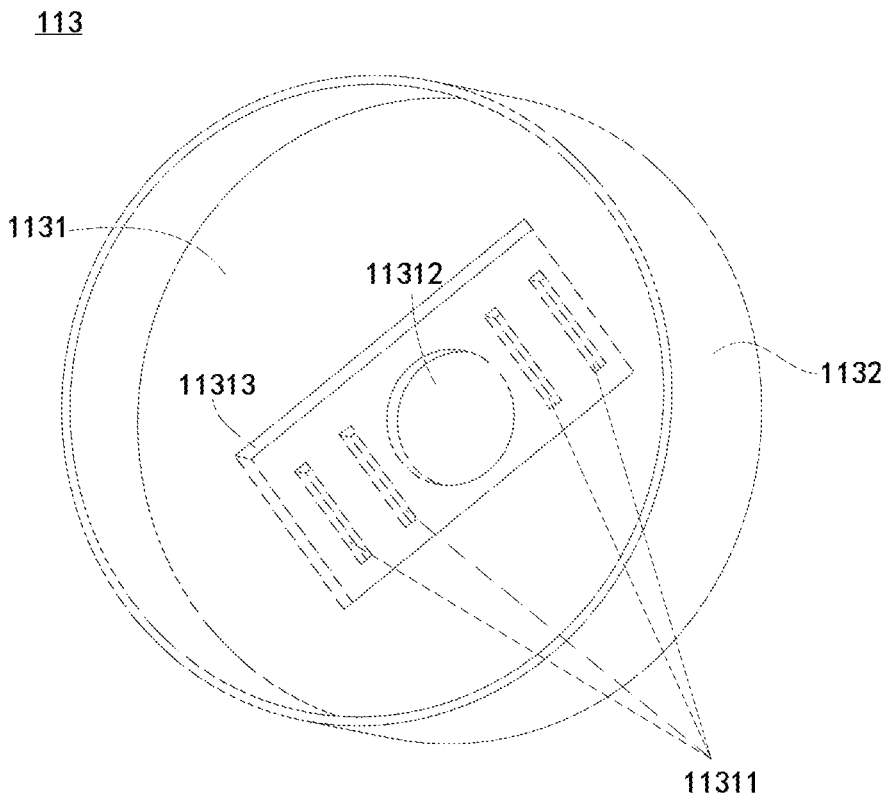
FIG. 5 is an enlarged isometric view of a base in the atomizer.

Referring to FIG. 5, which is an enlarged isometric view of a base in the atomizer. The fixing base 113 includes a basal portion 1131 and an extending portion 1132 extending from the basal portion 1131.

The basal portion 1131 is a cylinder; the basal portion 1131 of the fixing base 113 is bored with a liquid conducting hole 11311, a second air hole 11312 and a groove 11313. Specifically, the groove 11313 is positioned at a central of the bottom of the basal portion 1131. The groove 11313 is a rectangular-shaped groove, sinking upwards rather than passing through the basal portion 1131 and configured for installing the heating component 12. The basal portion 1131 has the liquid conducting hole 11311 and the second air hole 11312 bored thereon, corresponding with the groove 11313. The liquid conducting hole 11311 and the second air hole 11312 opened on the basal portion 1131 are both communicated with the groove 11313. The liquid conducting hole 11311 and the second air hole 11312 don't extend within the groove 11313. The second air hole 11312 is a round-shaped air hole, located at a central of the basal portion 1131, corresponding with the first air hole 1111, that means, the central axes of the first air hole 1111 and the second air hole 11312 are coaxial with each other. The liquid conducting hole 11311 is a rectangular-shaped through hole. The number of the liquid conducting hole 11311 is at least one, in the embodiments of the present disclosure, the number of the liquid conducting holes 11311 is four, each side of the second through hole 11312 has two of the four liquid conducting holes 11311 disposed symmetrically.

The extending part 1132 is a cylinder-structure, the fixing base 113 is rivet jointed with the base 14 via the extending part 1132, with the base 14 to form the case 15.

The shell 112 is a cylindrical structure, one end of the shell 112 is rivet jointed with the top cover 111 via a sealing glue 114; an opposite end of the shell 112 is rivet jointed with the basal portion 1131 via the sealing glue 114; a liquid storage chamber 11 formed by sealing connection of the shell 112, the top cover 111 and the fixing base 113, is configured for storing tobacco liquid, so the shell 112 is generally made by transparent materials, such as, glasses, which is convenient for users to see-through.

Furthermore, the heating component 12 is a core of the atomizer 10 heating the tobacco liquid, which includes: a case 121 and at least one heating element 122. The at least one heating element 122 is received in the case 121. And a liquid storage sump 123 is formed between the heating element 122 and the case 121 or between adjacent heating elements 122. The liquid storage sump 123 is configured for storing some of tobacco liquid leaking from the heating element 122, causing the heating element 122 to heat the leaking tobacco liquid stored in the liquid storage sump 123 to generate an aerosol.

The case 121 is rectangular-shaped, the size thereof is the same as the size of the groove 11313, enabling the heating component 12 to be installed in the groove 11313, the case 121 is rivet joint with the groove 11313, moreover, the inside of the case 121 is communicated with the second air hole 11312.

Figure 6:
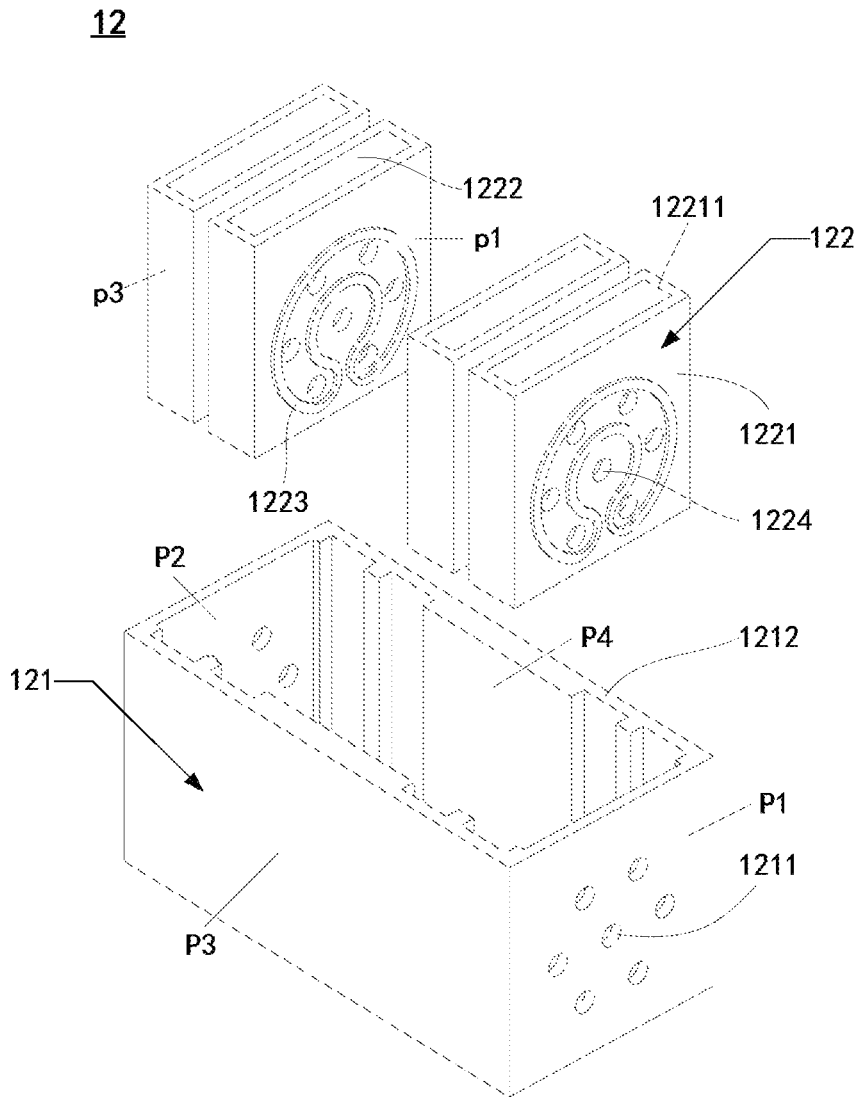
FIG. 6 is an enlarged isometric view of a heating component in the atomizer.

Two opposite side walls of the case 121 have the second through holes 1211 opposite with each other, the side wall is bounded by the intersection of a width and a height, P1 and P2 shown in FIG. 6. The second through holes 1211 are configured for allowing exterior air to flow into the case 121. As used herein, the number of the second through holes 1211 is at least one, and position of each second through hole 1211 is higher than the bottom of the liquid storage sump 123, making the liquid storage sump 123 capable of storing a certain amount of tobacco liquid, meanwhile avoiding the tobacco liquid in the liquid storage sump 123 leaking outside through the second through holes 1211. In the embodiment of the present disclosure, the number of the second through holes 1211 is seven.

Inner side walls of the case 121 have another set of slots 1212 opposite with each other, the side wall is bounded by the intersection of a length and a height, P3 and P4 as shown in FIG. 6. The number of set of slots 1212 has at least one set, two opposite slots 1212 works as one set. In the embodiment of the present disclosure, the number of sets of slots 1212 is four, extending along a length direction of the case 121 and symmetrically disposed on the length of the case 121. The position of the slot 1212 is corresponding with the position of the liquid conducting hole 11311 bored on the fixing base 113. The slot 1212 is configured for fixing the heating element 122, allowing the heating element 122 to be entirely received in the case 121; and when the heating element 12 is connected with the liquid storage chamber 11, the heating element 122 is corresponding with the liquid conducting hole 11311.

The heating element 122 is disposed below the liquid storage chamber 11 and corresponding with the liquid conducting hole 11311, the number of the heating elements 122 is the same as the number of the liquid conducting holes 11311, by controlling the number of the heating elements 122, the amount of the aerosol generated by the electronic cigarette 1 is controlled. A first through hole 1224 passing through the heating element 122 is bored on the side wall of the heating element 122, the number of the first through holes 1224 is at least one, configured for guiding the aerosol generated by atomization to outside the heating element 122. Furthermore, when the first through hole 1224 is received in the case 121, the first through hole 1224 is corresponding with the second through hole 1211, that means the number of the first through hole 1224 is the same as the number of the second through hole 1211. Meanwhile, each of the first though holes 1224 has a corresponding position with each of the second through holes 1211. The first through hole 1224 and the second through hole 1211 form an air pipe. When users draw, the exterior air pipe flow into the case 121 via the first through hole 1211, afterwards flowing into the second through hole 1224 and bringing the aerosol generated by atomizing the tobacco liquid to outside the heating element 122, further bringing the aerosol to the second through hole 11312 and flowing upwards, eventually drawn via the first through hole 1111 into the user's mouth. The number of the first through holes 1224 and the second through holes 1211 affect the flowing amount of the exterior airflow, thus affecting the amount of the aerosol.

Furthermore, each heating element 122 includes: a heating box 1221, a heating area 1223 and an absorption element 1222.

The heating box 1221 is rectangular, generally made by metallic or ceramic etc. some good heat conductive materials. The size of the heating box 1221 is corresponding with the size of the case 121. More specifically, the height of the heating box 1221 is the same as the height of the case 121, and the breadth of the heating box 1221 is the same as the breadth of the slot 1212 opened on the case 121; the length of the heating box 1221 is the same as a distance between two opposite slots 1212 so the heating box 1221 is capable of being fixed in the case 121, as well as forming the liquid storage sump 123 with the case 121. Moreover, when the heating box 1221 is received in the case 121, P1 side is opposite with p1 side in FIG. 6, that is, the side having the first through hole 1211 is opposite with the side having the second through hole 1224.

A heating compartment 12211 is formed inside the heating box 1221, an opening above the heating compartment 12211 is communicated with a top of the heating compartment 12211; when the heating compartment 12211 is fixed in the case 121 and the heating component 12 is connected with the liquid storage chamber 11, the opening above the heating compartment 12211 is corresponding with the liquid conductive hole 11311 and the size of the heating compartment 12211 is not less than the size of the liquid conductive hole 11311, enabling the tobacco liquid in the liquid storage chamber 11 entirely flowing into the heating compartment 12211 through the liquid conductive hole 11311.

The heating area 1223 is a resistive circuit printed on outside or inside surface of the heating box 1221. The heating area 1223, that is the resistive circuit, heats the heating box 1221 after provided by electricity, thus the heating box 1221 may heat the tobacco liquid. More specifically, in embodiments, the heating area 1223 is disposed on the p1 side of the heating box 1221, resembling a letter "C". Of course, in some alternative embodiments, the heating area 1223 may be set on other sides of the heating box 1221, not only one side but also multiple sides, shaped as back wire etc. Understandable, the heating area 1223 is also a heating layer coating on a surface of the heating box 1221, also a heating piece, a heating wire or a heating net etc. being sintered with the heating box 1221 as a whole.

The absorption element 1223 may be made by fiber materials, which is filled in the heating compartment in the heating box 1221, being capable of guiding tobacco liquid towards a vicinity of the heating box 1221 for heating. When the heating component 12 is connected with the liquid storage chamber 11, the absorption element 1222 contacts the liquid conductive hole 11311, enabling the tobacco liquid in the liquid storage chamber 11 to pass through the liquid conductive hole 11311 into the absorption element 1222.

Understandable, in terms of the heating component 12, firstly, printing the heating area 1223 on the heating box 1221, then filling the absorption element 1222 into the heating compartment in the heating box 1221 so that a heating element 122 is formed; afterwards, installing the heating elements 122 into corresponding slots 1212 according to the number and position of the liquid conductive holes 11311 thus the heating component 12 is formed, in this case, in the heating component 12, the first through hole 1224 is corresponding with the second through hole 1211 to form the air pipe, and the liquid storage sump 123 is formed by the heating elements 122, the heating box 1221 and adjacent heating elements 122, for storing some of tobacco liquid leaking from the heating elements 122; eventually, rivet jointing the component 12 with the groove 11313 in the liquid storage chamber 11. As described herein, the heating element 122 is disposed below the liquid conductive hole 11311, and the absorption element 122 of the heating element 122 contacts the liquid conductive holes 11311 of the liquid storage chamber 11, thus the tobacco liquid from the liquid storage chamber 11 may flow into the absorption element 1222 through the liquid conductive holes 11311, furthermore, guided by the absorption element 1222 to the vicinity of the heating box 1221 for atomization.

Furthermore, the air pipe 13 is a cylindrical structure, one end of the air pipe 13 is fixed in the first air hole 1111 bored on the top cover 111, an opposite end of the air pipe 13 is fixed in the second air hole 11312 of the fixing base 113. The air pipe 13 fixed in the second air hole 11312 is partially extending into the case 121, thus communicated with inside of the case 121 and enabling the aerosol generated by the heating element 122 to be drawn by the user via the air pipe 13. As used herein, the air pipe 13 is hermetically connected with the first air hole 1111 and the second air hole 11312, thus preventing leakage of the tobacco liquid.

Furthermore, the base 14 is connected with the fixing base 113 in the liquid storage chamber 11. More specifically, the base 14 is rivet connected with the extending part 1132 of the fixing base 113. The base 14 has an air inlet apparatus (not shown), when the user draws the electronic cigarette 1, exterior air is carrying the aerosol generated by the heating component 12 to form airflow in the air pipe of the electronic cigarette 1, further the airflow is drawn out. With the air inlet apparatus, the amount of the exterior air flowing to the electronic cigarette 1 is controlled, thus the amount of airflow drawn out is controlled.

The bottom of the base 14 is provided with a threaded connector 141. The atomizer 10 is coupled with the power supply 20 via the threaded connector 141 on the base 14.

Overall, understandable, when assembling the atomizer 10, firstly, assembling the heating component 12 containing: printing the heating area 1223 on the heating box 1221, then filling the absorption element 1222 in the heating compartment 12211 of the heating box 1221 to assemble the heating component 122; then fixedly connecting the air pipe 13 with the first air hole 1111 bored on the top cover 111, then the top cover 111 is rivet connected with one end of the shell 112 via a sealing glue 114; an opposite end of the shell 112 is rivet connected with the basal part 1131 of the fixing base 113 via the sealing glue 114. In this case, the second air hole 11312 bored on the basal part 1131 of the fixing base 113 is fixedly connected with an opposite end of the air pipe 13; at last, rivet connecting the heating component 12 with the groove 11313 on the basal part 1131 of the fixing base 113, in this case, the air pipe 13 is communicated with the heating component 12, the heating element 122 is disposed below the liquid conductive hole 11311, while the absorption element 1222 of the heating element 122 contacts the liquid conductive hole 11311. Thus the tobacco liquid in the liquid storage chamber 11 may flow towards the absorption element 1222 by gravity, and through the liquid conductive hole 11311, then the absorption element 1222 guides the tobacco liquid to the vicinity of the heating box 1221 to generate the aerosol. The leaked tobacco liquid may flow towards the heating component 12 by gravity to be stored in the liquid storage sump 123, can't be leaked to the air pipe 13. Since the tobacco liquid in the liquid storage sump 123 is near to the heating element 122, the tobacco liquid may be heated by the heating element 122 to generate the aerosol that is supplied to the user by the air pipe 13, which effectively avoids the user to draw the tobacco liquid. Ultimately, the base 14 is rivet connected with the extending part 1132 of the fixing base 113 to assemble the atomizer 10.

The atomizer 10 is coupled with the power supply 20 via the threaded connector 141 to assemble the electronic cigarette 1.

After the atomizer 10 is supplied power via the power supply 20, the heating element 122 heats to the tobacco liquid stored in the absorption element 1222 to generate the aerosol, while the leaked tobacco liquid, stored in the liquid storage sump 123, is heated to generate the aerosol, so that the leaked tobacco liquid may be consumed, effectively avoids a problem of the user drawing the tobacco liquid. The generated aerosol flows from the heating component 12 into the air pipe 13, when the user draws the mouth piece, the aerosol in the air pipe 13 is drawn to the user's mouth through the first air hole 1111.

Additional aspects and advantages of the present disclosure will be: the present disclosure relates to an atomizer and an electronic cigarette having same; the atomizer includes a liquid storage chamber and a heating component. The heating component includes a heating element and a case, the heating element is received in the case and a liquid storage sump is formed there-between. As used herein, the heating component is connected with the liquid storage chamber and the heating element is disposed above the liquid conductive hole so that the tobacco liquid stored in the liquid storage chamber will flow by gravity, towards the heating element for atomization. Furthermore, even through leakage of the tobacco liquid exists, the leaking tobacco liquid would flow towards the heating component, stored in the liquid storage sump of the heating component, thus the leaking tobacco is only capable of being stored in the heating component and can't leak to the inside air pipe of the atomizer, which effectively avoids the tobacco liquid to be drawn by the user, enhancing the user experience.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer comprising:

a liquid storage chamber configured for storing tobacco liquid; the liquid storage chamber comprising a liquid conducting hole;

a heating component comprising at least one heating element and a case; the at least one heating element being received in the case;

a liquid storage sump between the heating element and the case or between the adjacent heating elements;

the heating component being connected with the liquid storage chamber;

the heating element being disposed under the liquid storage chamber and corresponding with the liquid conductive hole;

the tobacco liquid in the liquid storage chamber flowing towards the heating element through the liquid conductive hole; the heating element being configured for heating the tobacco liquid for atomization; and the liquid storage sump configured for storing some of tobacco liquid leaking from the heating element, so that the heating element atomizes the tobacco liquid in the liquid storage sump.

2. The atomizer of claim 1, wherein the atomizer further comprises a base; wherein the base is connected with the liquid storage chamber to form a case; wherein the heating component is disposed in the case.

3. The atomizer of claim 1, wherein the heating element comprises:

a heating box made by heat conductive materials, the heating box comprising a heating compartment formed therein, an upper opening of the heating box being corresponding with the liquid conductive hole;

a heating area, formed on the heating box; and an absorption element, filled in the heating compartment; the absorption element contacting the liquid conductive hole.

4. The atomizer of claim 3, wherein the heating box is made by ceramic materials; the heating area is a resistive circuit printed on an outside or inside surface of the heating box.

5. The atomizer of claim 3, wherein a first through hole is bored on a lateral of the heating element, the first through extending through the heating element and being configured for guiding an aerosol generated by atomizing the tobacco liquid to outside of the heating element;

the case comprises a second through hole bored thereon, the second through hole being configured for guiding exterior air into the case;

the heating element is received in the receiving case; the first through hole and the second through hole are communicated with each other to form an air passage.

6. The atomizer of claim 5, wherein a total number of the first through holes is at least one; a total number of the second through holes is at least one; and a position of each second through hole bored is higher than a bottom of the liquid storage sump.

7. The atomizer of claim 1, wherein the atomizer further comprises an air pipe passing through the liquid storage chamber, wherein one end of the air pipe is communicated with inside the case.

8. The atomizer of claim 7, wherein the liquid storage chamber further comprises:

a shell;

a top cover connected with one end of the shell, wherein a first through hole is bored on the top cover;

a fixing base connected with another end of the shell, the fixing base comprising a second through hole communicated with the case; wherein one end of the air pipe is fixed inside the second through hole; an opposite end of the air pipe is fixed inside the first through hole.

9. The atomizer of claim 8, wherein the liquid conducting hole is bored on the fixing base.

10. The atomizer of claim 9, wherein the fixing base further comprises a groove formed thereon; the groove is communicated with the liquid conducting hole and the second through hole; the groove is configured for installing the heating component.

11. An electronic cigarette comprising a power supply and an atomizer, wherein the power supply is coupled with the atomizer and configured for supplying power to the atomizer; wherein the atomizer comprises:

a liquid storage chamber configured for storing tobacco liquid; the liquid storage chamber comprising a liquid conducting hole;

a heating component comprising at least one heating element and a case; the at least one heating element being received in the case;

a liquid storage sump between the heating element and the case or between the adjacent heating elements;

the heating component being connected with the liquid storage chamber;

the heating element being disposed under the liquid storage chamber and corresponding with the liquid conductive hole:

the tobacco liquid in the liquid storage chamber flowing towards the heating element through the liquid conductive hole: the heating element being configured for heating the tobacco liquid for atomization; and the liquid storage sump configured for storing some of tobacco liquid leaking from the heating element, so that the heating element atomizes the tobacco liquid in the liquid storage sump.

12. The electronic cigarette of claim 11, wherein the heating element comprises:

a heating box made by heat conductive materials, the heating box comprising a heating compartment formed therein, an upper opening of the heating box being corresponding with the liquid conductive hole;

a heating area, formed on the heating box; and an absorption element, filled in the heating compartment; the absorption element contacting the liquid conductive hole.

13. The electronic cigarette of claim 12, wherein the heating box is made by ceramic materials; the heating area is a resistive circuit printed on an outside or inside surface of the heating box.

14. The electronic cigarette of claim 12, wherein a first through hole is bored on a lateral of the heating element, the first through extending through the heating element and being configured for guiding an aerosol generated by atomizing the tobacco liquid to outside of the heating element;

the case comprises a second through hole bored thereon, the second through hole being configured for guiding exterior air into the case;

the heating element is received in the receiving case; the first through hole and the second through hole are communicated with each other to form an air passage.

15. The electronic cigarette of claim 14, wherein a total number of the first through holes is at least one; a total number of the second through holes is at least one; and a position of each second through hole bored is higher than a bottom of the liquid storage sump.

16. The electronic cigarette of claim 11, wherein the atomizer further comprises an air pipe passing through the liquid storage chamber, wherein one end of the air pipe is communicated with inside the case.

17. The electronic cigarette of claim 16, wherein the liquid storage chamber further comprises:

a shell;

a top cover connected with one end of the shell, wherein a first through hole is bored on the top cover;

a fixing base connected with another end of the shell, the fixing base comprising a second through hole communicated with the case; wherein one end of the air pipe is fixed inside the second through hole; an opposite end of the air pipe is fixed inside the first through hole.

18. The electronic cigarette of claim 17, wherein the liquid conducting hole is bored on the fixing base.

19. The electronic cigarette of claim 18, wherein the fixing base further comprises a groove formed thereon; the groove is communicated with the liquid conducting hole and the second through hole; the groove is configured for installing the heating component.

* * * * *